US007147116B1

(12) United States Patent
Cape

(10) Patent No.: US 7,147,116 B1
(45) Date of Patent: Dec. 12, 2006

(54) PORTABLE DRYING ASSEMBLY

(76) Inventor: Thomas Harry Cape, 3175 Beckley Rd., Battle Creek, MI (US) 49015

( * ) Notice: Subject to any disclaimer, the term of this patent is extended or adjusted under 35 U.S.C. 154(b) by 193 days.

(21) Appl. No.: 10/877,265

(22) Filed: Jun. 25, 2004

Related U.S. Application Data

(60) Provisional application No. 60/484,516, filed on Jul. 3, 2003.

(51) Int. Cl.
*A47B 43/00* (2006.01)

(52) U.S. Cl. ..... 211/115; 211/197; 211/85.3; 211/113; 211/115

(58) Field of Classification Search ..... 211/85.3, 211/95, 96, 115, 118, 113, 116, 197
See application file for complete search history.

(56) References Cited

U.S. PATENT DOCUMENTS

| | | | | | |
|---|---|---|---|---|---|
| 40,936 | A | * | 12/1863 | Horn | 211/115 |
| 433,859 | A | * | 8/1890 | Foster | 211/95 |
| 448,049 | A | * | 3/1891 | Judkins | 211/85.3 |
| 537,586 | A | * | 4/1895 | Schmidt | 211/116 |
| 717,439 | A | * | 12/1902 | McCloskey | 211/116 |
| 772,816 | A | * | 10/1904 | McCloskey | 211/116 |
| 1,176,578 | A | * | 3/1916 | McCabe | 211/95 |
| 1,205,773 | A | * | 11/1916 | Michaud | 211/95 |
| D56,476 | S | * | 10/1920 | Reynolds | D6/514 |
| 1,464,160 | A | * | 8/1923 | Weyel | 248/340 |
| 1,684,153 | A | * | 9/1928 | Smith | 211/101 |
| 1,937,911 | A | * | 12/1933 | Pajeau | 211/116 |
| 2,325,478 | A | * | 7/1943 | Collins | 211/113 |
| 2,554,825 | A | | 5/1951 | Grimberg | |
| D265,045 | S | * | 6/1982 | Taniyama | D32/58 |
| 5,437,378 | A | * | 8/1995 | Ta | 211/115 |
| 5,901,888 | A | * | 5/1999 | Schneider et al. | 223/89 |
| 6,343,726 | B1 | * | 2/2002 | Wu | 223/88 |
| 6,425,490 | B1 | * | 7/2002 | Ta | 211/116 |

* cited by examiner

*Primary Examiner*—Richard E. Chilcot, Jr.
*Assistant Examiner*—Lindsay Maguire
(74) *Attorney, Agent, or Firm*—Joseph K. Andonian

(57) ABSTRACT

A compact, portable device for hanging clothes and the like in locations where ordinary drying facilities are not conveniently available. Rigid wires hinged inside a hub and radiating around the hub like the ribs of an inverted umbrella assume a horizontal position for hanging clothes and a vertical position for storage and transport. A wire bent in the shape of a hook is rotatably attached to the center of the hub to facilitate hanging the device during the drying operation.

1 Claim, 7 Drawing Sheets

PORTABLE DRYING ASSEMBLY

This invention relates to a compact portable assembly suitable for drying clothes and the like under circumstances where ordinary drying facilities are not conveniently available.

BACKGROUND OF THE INVENTION

U.S. Pat. No. 2,554,825 relates to a portable drier having two strips of thin substantially rigid strips pivotally attached independently to a U-shaped supporting member. A hook is pivotally secured to the center of the U-shaped member to function as a hanger for the drier. Hanger members are attached to the strips to function as clothespins. The strips fold into the bottom of the U-shaped member to a horizontal position for hanging clothes and pivot vertically out of the open ends of the U-shaped member for storage and transport.

The present invention differs substantially from the above patent in providing more hanger capacity without sacrificing convenience or cost by utilizing several equally spaced spoke-like elements radiating outwardly from a substantially circular hub. The patent employs two thin flat-sided strips secured by eyelet fasteners to the inside of a U-shaped support. The present invention employs more rounded elements that independently function like rigid clotheslines that are fastened to the hub in a hinge-like relationship. Pivoting movement of the hanger elements in the U-shaped channels of the prior art patent is accomplished by using eyelet fasteners. Pivoting movement of the spoke-like elements of the present invention is accomplished by providing a hinge mechanism inside the hub to permit the spoke-like elements to move from a horizontal position for hanging clothes and the like to a vertical position for storage or transport. One end of the spoke-like elements of the present invention, hereinafter referred to as horizontal supports, is bent at a 90 degree angle and fitted into channels molded inside the assembled hub like the pin in a door hinge. These hinge channels are also oriented at a 90 degree angle from the closed end of U-shaped channels. The horizontal supports rest in the bottoms of the U-shaped channels when oriented horizontally for hanging clothes and the like. Unattached clothes pins or clamps are used to hang clothes and the like to the horizontal supports. This arrangement permits more than two horizontal supports to radiate outward from the hub and thereby provide more hanging space than the limit of two provided by the prior art patent. This arrangement also simplifies manufacture and reduces costs and yet provides more drying capacity in both weight and volume while providing a more compact assembly that is easier to use and store or transport. It is ideal for use wherever ordinary washing and drying facilities are not available, especially where space for hanging and drying clothes are limited, such as an apartment, a college dorm, hotel room, mobile home, campground or recreational vehicle. It is especially suitable for use by the military in the field living in tents.

When describing the present assembly and its parts, the terms "horizontal" and "vertical" refer to an orientation in which the assembly is positioned in space so that the horizontal supports are parallel to the horizon or floor and the vertical support is perpendicular to the horizontal supports. Likewise "inside" and "outside" surfaces refer to surfaces closest to and furthest from the center of the hub and "top" and "bottom" surfaces refer to surfaces of the hub or its two parts when the hub as part of the whole assembly is positioned in space so that the horizontal supports are horizontal as described above.

SUMMARY OF THE INVENTION

The present invention comprises a compact, light weight apparatus suitable for easy packing and transport in baggage and quick conversion to a clothes drier in the open field such as a campsite or closed accommodations where space is limited such as a hotel room or recreational vehicle. The assembled apparatus comprises a hub, a hook ended vertical support and spoke-like horizontal supports that radiate outward from the hub. The horizontal supports are connected to the hub by a hinging mechanism that permits the horizontal supports to assume a horizontal or vertical position like the ribs of an inverted umbrella. Clothes are attached to the horizontal supports equally spaced around a plastic hub using ordinary clothespins or clips. The hub is a two piece molded plastic product fastened together with adhesive after one end of each of the horizontal supports is placed into positions that serve as channels inside the completed hub. One end of the horizontal components is preferably bent at a right angle to fit inside the channel formed inside the hub when the two parts of the hub are fastened together, preferably with adhesive. The remainder of each horizontal support extends away from the center of the hub in U-shaped channels formed when the two pieces of the hub are fastened together and continues out and away from the U-shaped channels beyond the periphery of the completed hub. The right-angled portion of the horizontal supports acts like the pin in a door hinge and enables the horizontal supports to rotate from the bottom of the U-shaped channels to a vertical position in relation to the top surface of the hub. The bottom of each U-shaped channel is parallel to the top surface of the hub to establish a horizontal orientation for the horizontal supports. The end of the U-shaped channels closest to the center of the hub is perpendicular to the top surface of the hub to function as a stop that enables the horizontal supports to assume a vertical position in relation to the top surface of the hub. A hole is provided in the center of the hub to accommodate a hook ended vertical support rotatably fastened to the center of the hub to enable the assembly to rotate around the vertical support to facilitate both attaching and drying clothes. Although the invention is most suitable for drying all types of clothes from undergarments to outerwear, it can be used for a wide variety of products that are suitable for drying by hanging in the air. For example it can be used to dry strips of pasta or wet print film. It can be hung outside on a tree limb, inside on a shower curtain rod or on a cross bar attached to a tent pole using a U bolt.

LIST OF REFERENCE NUMERALS

Figure 1:
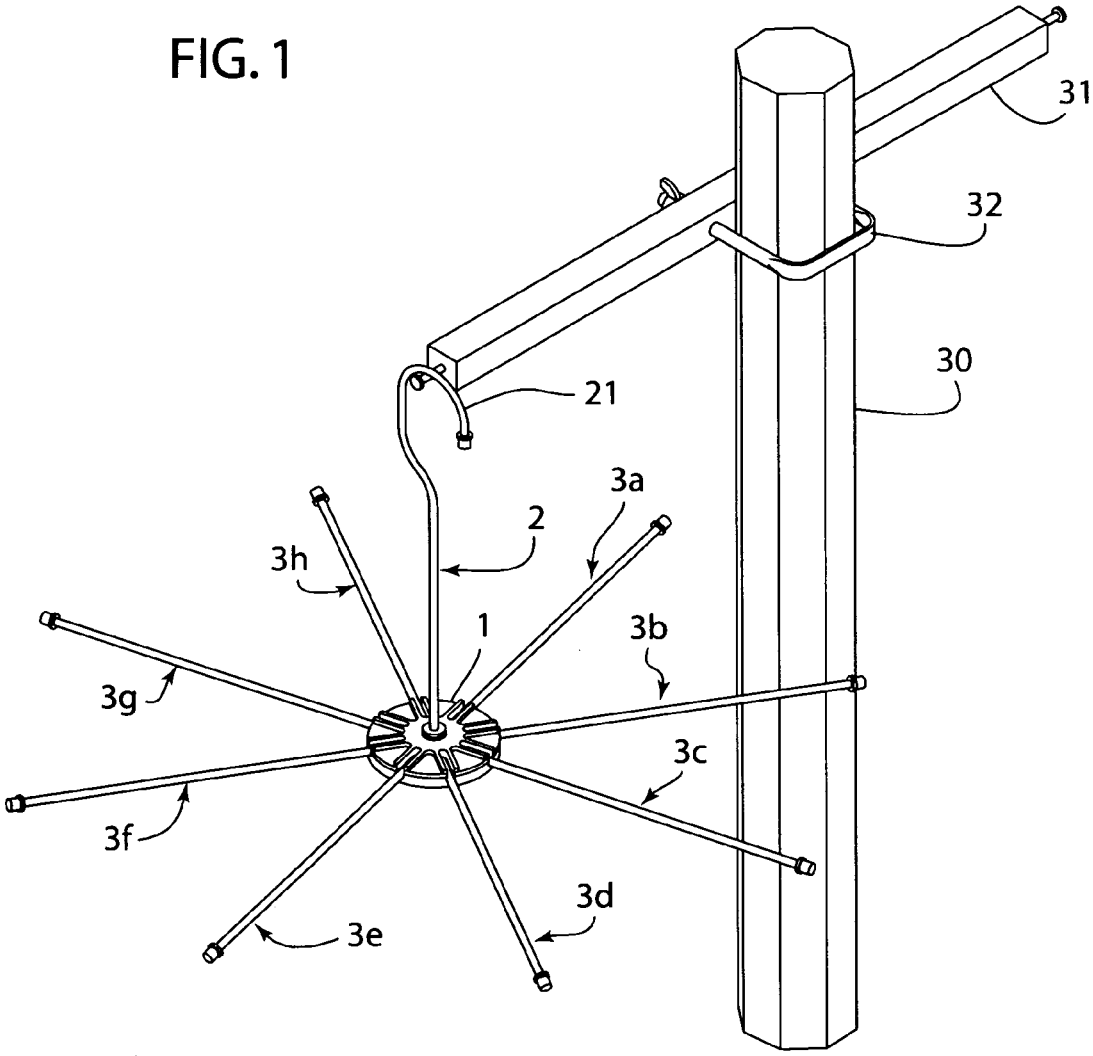
FIG. 1 is a perspective view of the apparatus of the present invention hanging from a crossbar attached to a tent pole.
Figure 2:
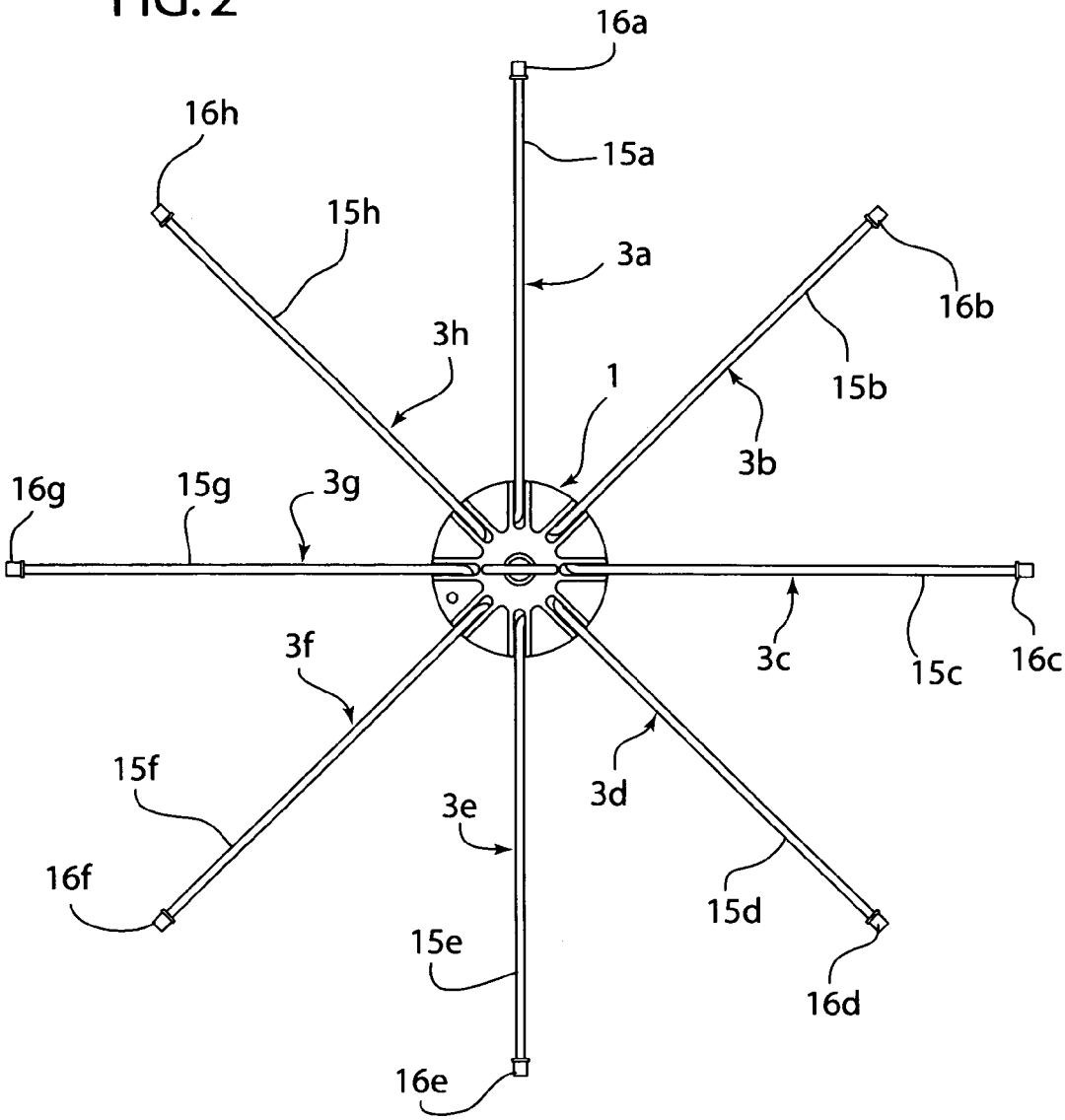
FIGS. 2 and 3 are top and side views of the assembled apparatus.
Figure 3:
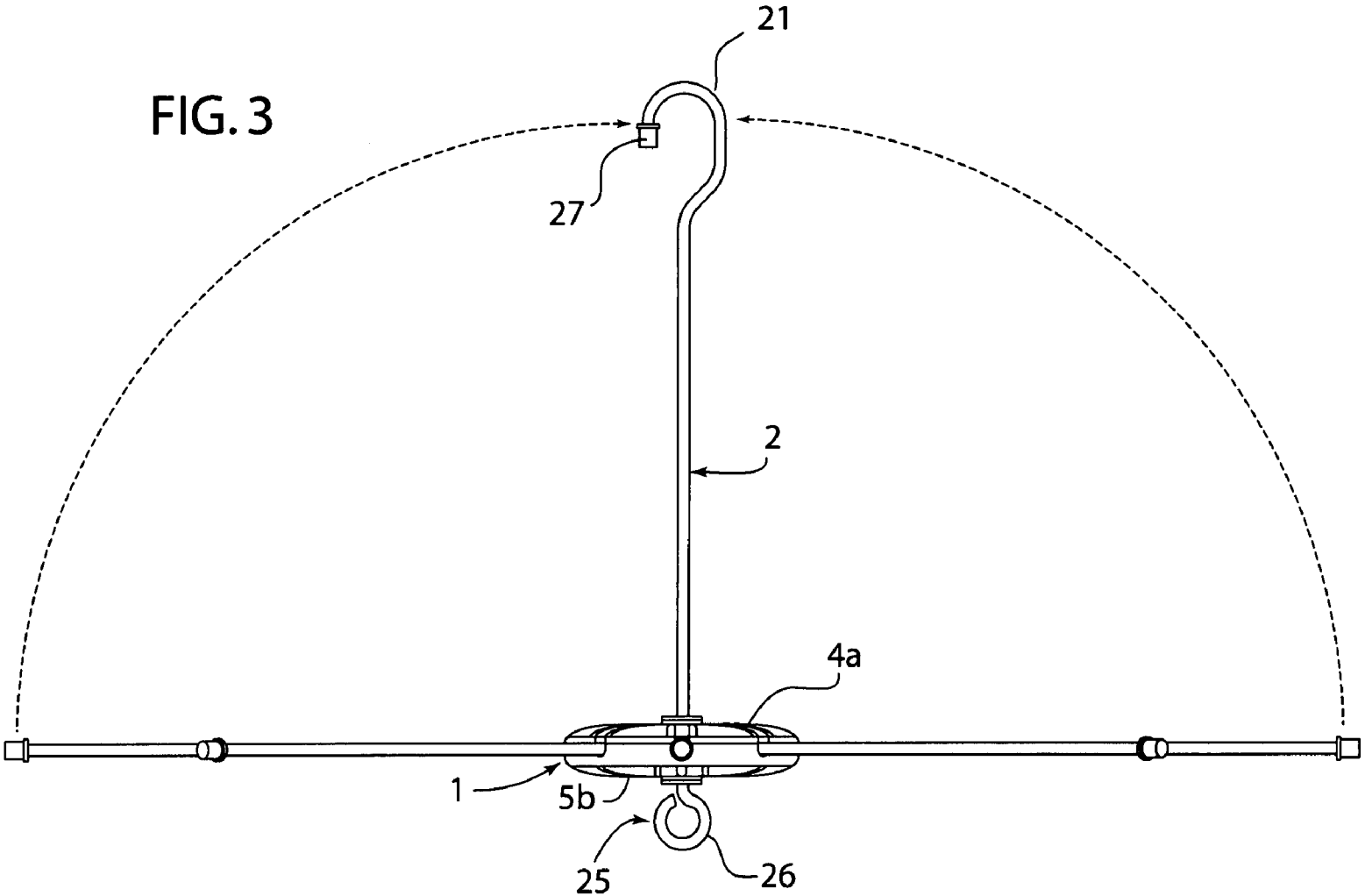

1 Hub
2 Vertical support wire
3*a*, 3*b*, 3*c*, 3*d*, 3*e*, 3*f*, 3*g*, 3*h* Horizontal Support Wires
4 Top half of hub
4*a* Top surface of top half of hub
4*b* Bottom surface of top half of hub
5 Bottom half of hub
5*a* Top surface of bottom half of hub
5*b* Bottom surface of bottom half of hub
6*a*, 6*b*, 6*c* U-shaped channels for spoke-like horizontal supports
6*i*, 6*j*, 6*k*, 6*l*, 6*m*, 6*n*, 6*o*, 6*p* Top of U-shaped channels
6*q*, 6*r*, 6*s*, 6*t*, 6*u*, 6*v*, 6*w*, 6*x* Bottom of U-shaped channels
7*a*, 7*b*, 7*c*, 7*d*, 7*e*, 7*f*, 7*g*, 7*h* Outside surface of hinge channel
8*a*, 8*b*, 8*c*, 8*d*, 8*e*, 8*f*, 8*g*, 8*h* Inside surface of hinge channel
9*a*, 9*b*, 9*c*, 9*d*, 9*e*, 9*f*, 9*g*, 9*h* cover over hinge channel
10*a*, 10*b*, 10*c*, 10*d*, 10*e*, 10*f*, 10*g*, 10*h* Bottom surface of hinge channel
11 Center hole in hub
11*a* Top half of center hole in hub
11*b* Bottom half of center hole in hub
14*a*, 14*b*, 14*c*, 14*d*, 14*e*, 14*f*, 14*g*, 14*h* Internal ends of horizontal supports
15*a*, 15*b*, 15*c*, 15*d*, 15*e*, 15*f*, 15*g*, 15*h* External ends of horizontal supports
16*a*, 16*b*, 16*c*, 16*d*, 16*e*, 16*f*, 16*g*, 16*h* End caps for horizontal supports
17*a*, 17*b*, 17*c*, 17*d* Washers
18*a*, 18*b* Lock rings
19*a*, 19*b*, 19*c*, 19*d*, 19*e*, 19*f*, 19*g*, 19*h* Closed ends of U-shaped channels
20*a*, 20*b*, 20*c*, 20*d*, 20*e*, 20*f*, 20*g*, 20*h* Open ends of U-shaped channels
21 Hook end of vertical support
25 Eyelet end of vertical support
26 Eyelet
27 End-cap for vertical support
28 Guide Pin
29 Guide Pin hole
30 Tent Pole
31 Crossbar
32 U-Bolt

DETAILED DESCRIPTION

As more clearly displayed in FIGS. 1–7 the preferred operational configuration of the present invention consists essentially of a molded plastic two piece hub 1; eight rigid horizontal support wires 3*a*, 3*b*, 3*c*, 3*d*, 3*e*, 3*f*, 3*g*, 3*h* hinged inside the hub 1, and a vertical support wire 2 rotatably connected to the center 11 of the hub 1 at one end 25 and configured in the shape of a hook at the other end 21. The bill of material for the complete preferred assembly consists of 8 horizontal support wires 3*a*, 3*b*, 3*c*, 3*d*, 3*e*, 3*f*, 3*g*, 3*h*; one vertical support wire 2; a hub 1 consisting of two pieces 4,5; 24 clothespins or clamps (not shown); an adhesive (not shown); 9 end caps 16*a*, 16*b*, 16*c*, 16*d*, 16*e*, 16*f*, 16*g*, 16*h*, 27; two lock rings 18*a*,18*b* and 4 washers 17*a*, 17*b*, 17*c*, 17*d*.

The two pieces 4,5 of the hub 1 are plastic molds 2.75 inches in diameter, preferably composed of acrylonitrile-butadiene-styrene (ABS). The two pieces 4,5 of the hub 1 are preferably fastened together using adhesive Devcon Plastic Weld II #14340.

The horizontal support wires 3*a*, 3*b*, 3*c*, 3*d*, 3*e*, 3*f*, 3*g*, 3*h* are preferably 0.125 inches in diameter, 13.5 inches long and composed of baked powder coated bright basic C1008 hard drawn wire. The powder coating is approximately 0.003–4 inches thick. One half inch of one end 21 of each of the horizontal support wires 3*a*, 3*b*, 3*c*, 3*d*, 3*e*, 3*f*, 3*g*, 3*h* is bent at a 90 degree angle. This end 21 is intended to act like the pin in a door hinge when fitted into channels provided inside the hub 1.

The vertical support wire 2 is preferably 13.75 inches long and composed of baked powder coated bright basic C1008 wire 0.156 inches in diameter. The hook end 21 of the vertical support wire 2 is preferably 3.23 inches in length and is bent back from the vertical on a radius of 1.72 inches and rounded back toward the vertical on a 1.5 inch radius and curved back to and past the vertical to an open end point 0.88 inches from the top of the hook on a diameter of 1.50 inches. A 0.38 eyelet 26 is formed at the other end 25 of the vertical support wire 22. The powder coating is applied to the vertical support 2 with the lock rings 18*a*, 18*b* attached to their appropriate positions on the vertical support 2. The top lock ring 18*a* is detached after it is powder coated The four washers 17*a*, 17*b*, 17*c*, 17*d* are either steel CAD plate or brass having dimensions of 0.171 inches inside diameter ×0.5 inches outside diameter ×0.09 inches thick. Two such washers are employed on each side of the hub 1 to fasten the vertical support 2 to the hub 1. They fit into shallow recesses (not shown) provided around the center hole 11 on the top 4*a* and bottom 5*b* surfaces of the hub 1.

The lock rings 18*a*, 18*b* are preferably ARCON 1500 PP E Ring 5/32 phosphate. One is used on each side of the hub 1 to hold the washers 17*a*, 17*b*, 17*c*, 17*d* against the top 4*a* and bottom 4*b* surfaces of the hub 1. In combination the washers 17*a*, 17*b*, 17*c*, 17*d* and lock rings 18*a*, 18*b* fasten the vertical support 2 to the hub 1 and permit the hub 1 to rotate freely around the vertical support 2.

Figure 4:
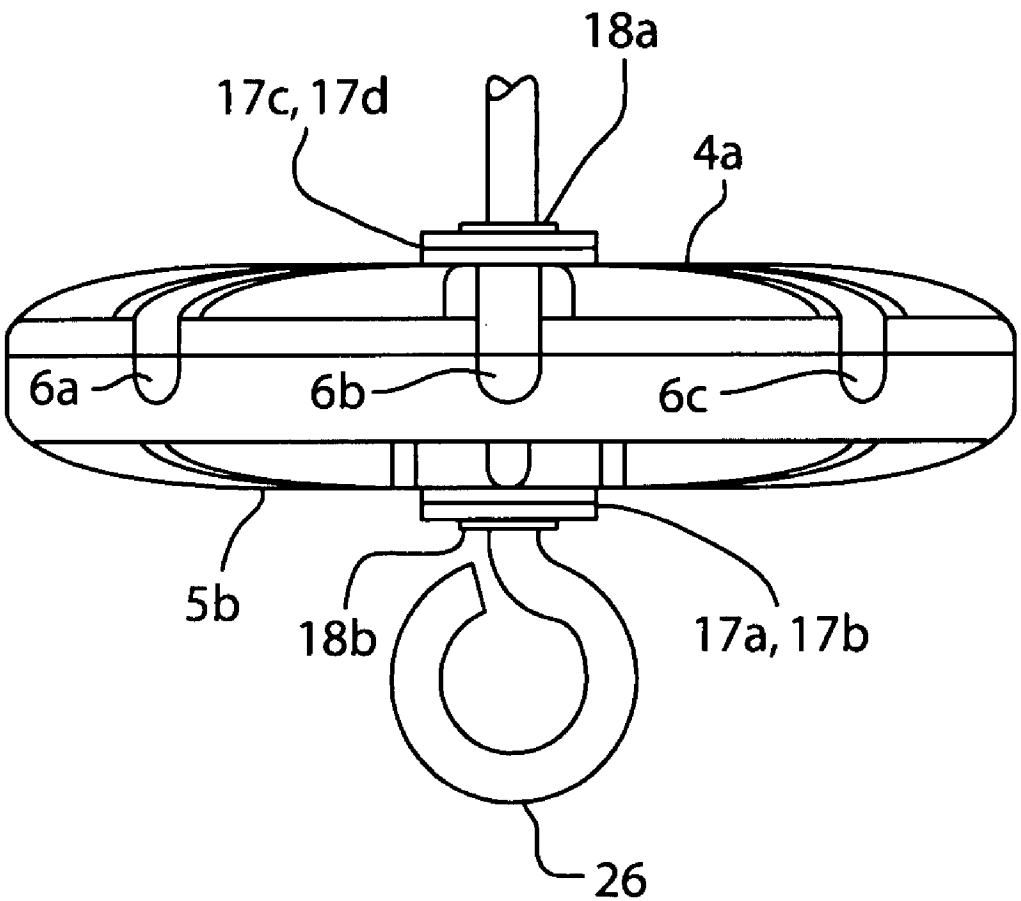
FIG. 4 is an enlarged frontal view of the hub with portions of the horizontal and vertical supports attached.
Figure 5:
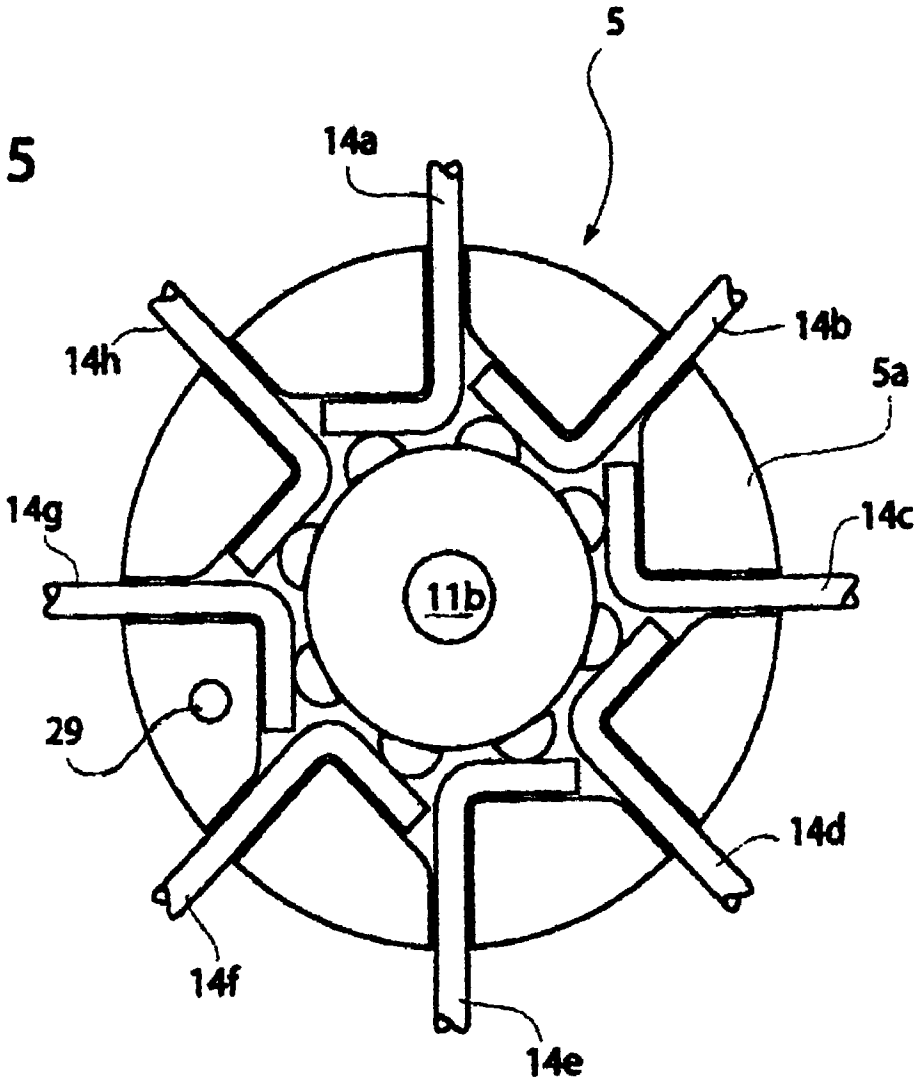
FIG. 5 is a top view of the bottom half of the hub showing how the internal ends of the horizontal supports are fitted on the bottom half of the hub.
Figure 6:
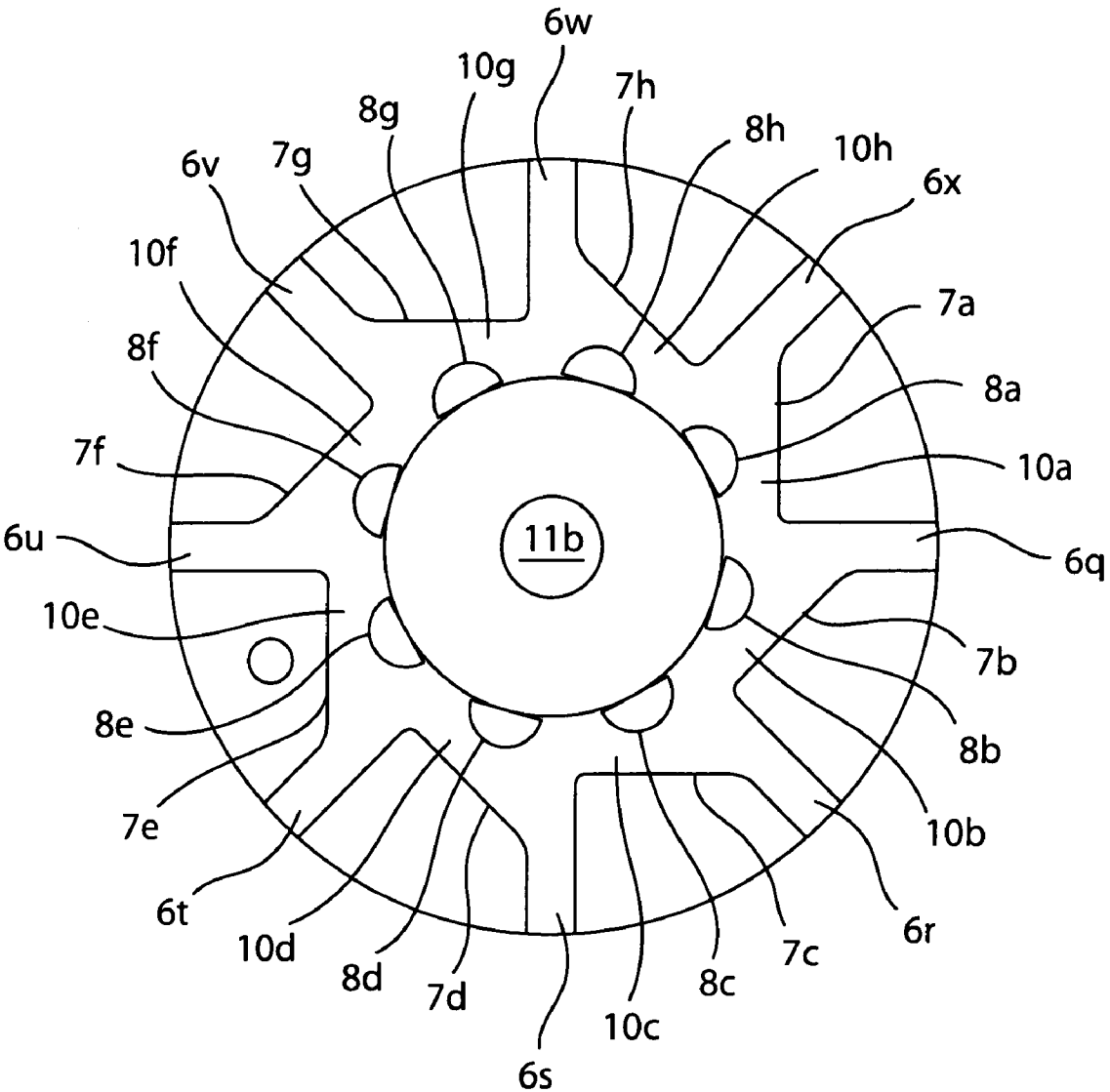
FIG. 6 is a top view of the bottom half of the hub without horizontal supports
Figure 7:
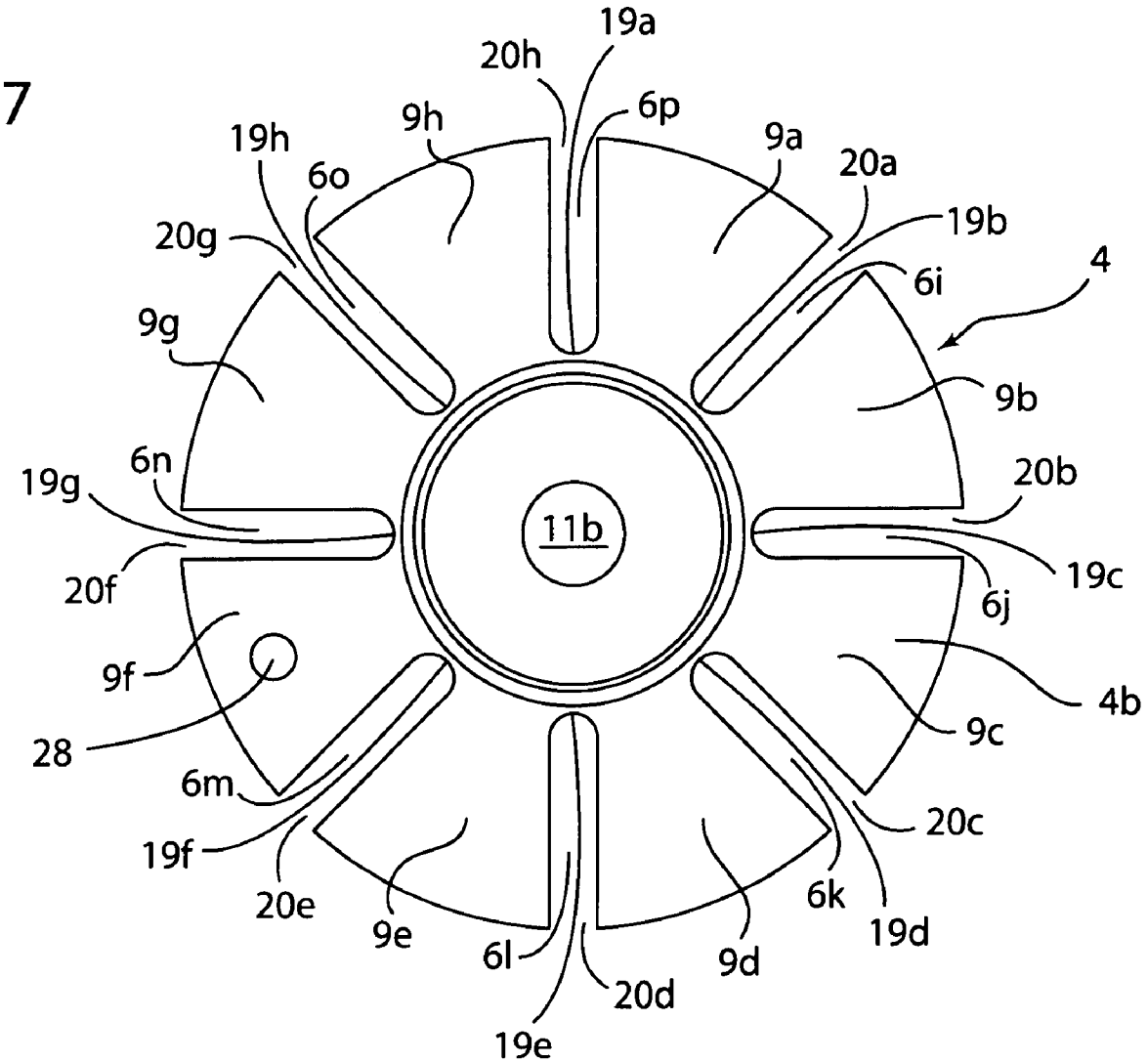
FIG. 7 is a bottom view of the top half of the hub.

The parts of the present apparatus are assembled in the following manner. The two parts 4, 5 of the hub 1 are injection molded. The end caps 16*a*, 16*b*, 16*c*, 16*d*, 16*e*, 16*f*, 16*g*, 16*h* are attached to the straight or open ends 15*a*, 15*b*, 15*c*, 15*d*, 15*e*, 15*f*, 15*g*, 15*h* of the horizontal supports 3*a*, 3*b*, 3*c*, 3*d*, 3*e*, 3*f*, 3*g*, 3*h* using adhesive. After the adhesive hardens or fixes, the bent or internal ends 14*a*, 14*b*, 14*c*, 14*d*, 14*e*, 14*f*, 14*g*, 14*h* of the horizontal supports 3*a*, 3*b*, 3*c*, 3*d*, 3*e*, 3*f*, 3*g*, 3*h* are positioned in the top surface 5*a* of the bottom half 5 of the hub 1 as shown in FIG. 5 in contact with the bottom 6*q*, 6*r*, 6*s*, 6*t*, 6*u*, 6*v*, 6*w*, 6*x* of the U-shaped channels (three of which are best shown in FIG. 4 as 6*a*, 6*b* and 6*c*) and the bottom 10*a*, 10*b*, 10*c*, 10*d*, 10*e*, 10*f*, 10*g*, 10*h*, outside 7*a*, 7*b*, 7*c*, 7*d*, 7*e*, 7*f*, 7*g*, 7*h* and inside 8*a*, 8*b*, 8*c*, 8*d*, 8*e*, 8*f*, 8*g*, 8*h* surfaces of the hinge channels as shown in FIG. 6. Adhesive is spread on the bottom surface 4*a* of top half 4 of the hub 1 and the top surface 5*a* of the bottom half 5 of the hub 1, being careful to avoid placing adhesive on the horizontal supports 3*a*, 3*b*, 3*c*, 3*d*, 3*e*, 3*f*, 3*g*, 3*h* and the surfaces 7- 8- 9- 10-*a, b, c, d, e, f, g, h* (surfaces shown in FIGS. 6 and 7) which will form the channels inside the hub 1 for the bent or internal portion of the horizontal supports 3*a*, 3*b*, 3*c*, 3*d*, 3*e*, 3*f*, 3*g*, 3*h*. The two parts 4, 5 of the hub 1 are fastened together using the guide pin 28 provided on the bottom surface of the top half of the hub to fit into the corresponding hole 29 in the top surface of the bottom half 5*a* of the hub 1 and thereby align the open or top ends of the U-shaped channels 6*a*, 6*b*, 6*c*, 6*d*, 6*e*, 6*f*, 6*g*, 6*h* provided in the top half 4 of the hub 1 with the closed or bottom ends of the U-shaped channels 6*a*, 6*b*, 6*c*, 6*d*, 6*e*, 6*f*, 6*g*, 6*h* provided in the bottom half 5 of the hub 1 (see FIGS. 5 and 6). After the adhesive is allowed to harden or fix, two washers 17*a*, 17*b* are passed over the hook end 21 of the vertical support 2 and allowed to settle over the lock ring 18*b* still in position on the vertical support 2 as indicated above. The hook end 21 of the vertical support 2 is fitted through the opening or center hole 11 in the center of the hub 1 and the hub 1 is allowed to settle over the washers 17*a*, 17*b* already positioned at the bottom of the vertical support 2. The remaining two washers 17*c*, 17*d* are then passed over the hook end 21 of the vertical support 2 and allowed to settle over the top surface 4*a* of the hub 1 in the recesses (not shown) provided around the center hole 11 in the top surface 4*a* of the of the top half 4 of the hub 1. The top lock ring 18*a* is then attached over the two washers 17*c*, 17*d* on the top of the hub 1. Finally an end cap 27 is attached to the open end of the hook on the top end 21 of the vertical support 2 with adhesive. After the adhesive fixes, the assembly is complete. The completed hub 1 with its attachments is seen most clearly in FIG. 4. The total weight of the completed assembly is only 8.8 ounces and yet is capable of holding 176 ounces of clothing.

To use the completed assembly for hanging clothes in a hotel, the assembly can be hung on the shower curtain rod usually found in the bathroom using the hook on the end of the vertical support 21 and allowing the horizontal support wires 3*a*, 3*b*, 3*c*, 3*d*, 3*e*, 3*f*, 3*g*, 3*h* to rotate from an upright position down into the U-shaped channels 6*a*, 6*b*, 6*c*, 6*d*, 6*e*, 6*f*, 6*g*, 6*h* provided in the hub 1 to assume a horizontal orientation. Clothes pins (not shown) loosely provided with the assembly are used to hang clothes on the horizontal support wires 3*a*, 3*b*, 3*c*, 3*d*, 3*e*, 3*f*, 3*g*, 3*h*. For packing after use the horizontal support wires 3*a*, 3*b*, 3*c*, 3*d*, 3*e*, 3*f*, 3*g*, 3*h* are folded back against the stops formed by the closed ends of the U-shaped channels 19*a*, 19*b*, 19*c*, 19*d*, 19*e*, 19*f*, 19*g*, 19*h* and unit is ready to pack. For use by military personnel in field the assembly can be hung outside on a tree limb or a hook provided in a crossbar 31 attached to a tent pole 30 using a U-bolt 32 as shown in FIG. 1. In actual trials the preferred assembly described herein is capable of drying 176 ounces of standard military issue clothing, including at the minimum, 2 BVD field pants and jackets, 2 sets of underwear, 2 pairs of socks, 2 handkerchiefs and 2 hats.

The foregoing provides both a general description and a specific description of the preferred embodiment of the invention. It should be understood that various substitutions, variations and modifications can be made by those skilled in the art without departing from spirit and scope of the invention as further delineated in the following claims.

I claim:

1. A compact collapsible portable assembly for hanging and drying a wide variety of products suitable for drying by hanging in air comprising (1) a vertical support element adapted to serve as a hanger for the assembly having a lower end and a hook ended upper end, (2) four or more rigid horizontal support elements having internal ends adapted to serve as part of a hinging mechanism and external ends adapted for hanging said products, said internal ends bent at a right angle in relation to said external ends, and (3) a substantially circular hub element comprising a top half and a bottom half wherein each half has a top surface, a bottom surface, a center hole and a periphery and the bottom surface of the top half is affixed to the top surface of the bottom half to form said hub wherein said hub (a) rotates around the lower end of said vertical support, (b) provides vertically oriented U-shaped channels in and out of which the external ends of said horizontal supports can move from a horizontal to a vertical position each said U-shaped channel having (i) a bottom in the lower half of said hub on which the external ends can rest when in a horizontal position, (ii) an open top extending from the bottom half of said hub through the top half of said hub out of which the external ends can move from a horizontal to a vertical position, (iii) a closed end oriented toward the center hole of said hub extending from the bottom half of said hub to the top half of said hub against which the external ends can butt when in a vertical position and (iv) an open end oriented toward the periphery of said hub out of which said horizontal supports can extend to provide hanging surfaces and (c) provides a second set of channels having bottom surfaces, front surfaces and back surfaces in the top surface of the bottom half of said hub said second set of channels aligned and connected at a right angle to the closed end of said U-shaped channels and thereby fully enclose the said internal ends of said horizontal supports in combination with the bottom surface of the top half of said hub and together with said internal ends of said horizontal supports provides a hinging mechanism when the bottom surface of the top half of said hub is affixed to the top surface of the bottom half of said hub.

* * * * *